United States Patent [19]

Schellhorn

[11] 4,197,828

[45] Apr. 15, 1980

[54] APPARATUS FOR CUTTING CONCRETE COLUMNS

[75] Inventor: Verne L. Schellhorn, Concord, Calif.

[73] Assignee: Aerial Industrial Inc., Concord, Calif.

[21] Appl. No.: 905,354

[22] Filed: May 12, 1978

Related U.S. Application Data

[63] Continuation-in-part of Ser. No. 726,272, Sep. 24, 1976, abandoned.

[51] Int. Cl.[2] ..... B28D 1/32

[52] U.S. Cl. ..... 125/23 C; 83/694

[58] Field of Search ..... 83/694; 125/23; 225/102; 299/70; 30/241; 61/53.5

[56] References Cited

U.S. PATENT DOCUMENTS

| | | | |
|---|---|---|---|
| 82,886 | 10/1868 | Tucker | 83/198 |
| 1,366,693 | 1/1921 | Kemble | 225/102 X |
| 3,056,267 | 10/1962 | McRee | 30/241 X |
| 3,496,813 | 2/1970 | Valente | 83/694 X |
| 3,727,599 | 4/1973 | Sugiki | 125/23 R |
| 3,978,842 | 9/1976 | Coffman | 125/23 R |
| 4,044,749 | 8/1977 | Bowen | 125/23 R |
| 4,124,015 | 11/1978 | Isaksson | 125/23 R |

*Primary Examiner*—Harold D. Whitehead
*Attorney, Agent, or Firm*—Bruce H. Johnsonbaugh

[57] ABSTRACT

Apparatus for cutting a concrete column by engaging the column between superimposed anvil and shear elements. The elements define a shear plane therebetween and the anvil element is conformed to embrace the column over an area of sufficient breadth to confine the portion of the column to the anvil side of the shear line against substantial fracturing. The elements are secured together for movement into and out of engagement with the column and an hydraulic cylinder is coupled between the elements to force the shear element against the column with sufficient pressure to fracture and crush the column.

15 Claims, 7 Drawing Figures

FIG. 1.
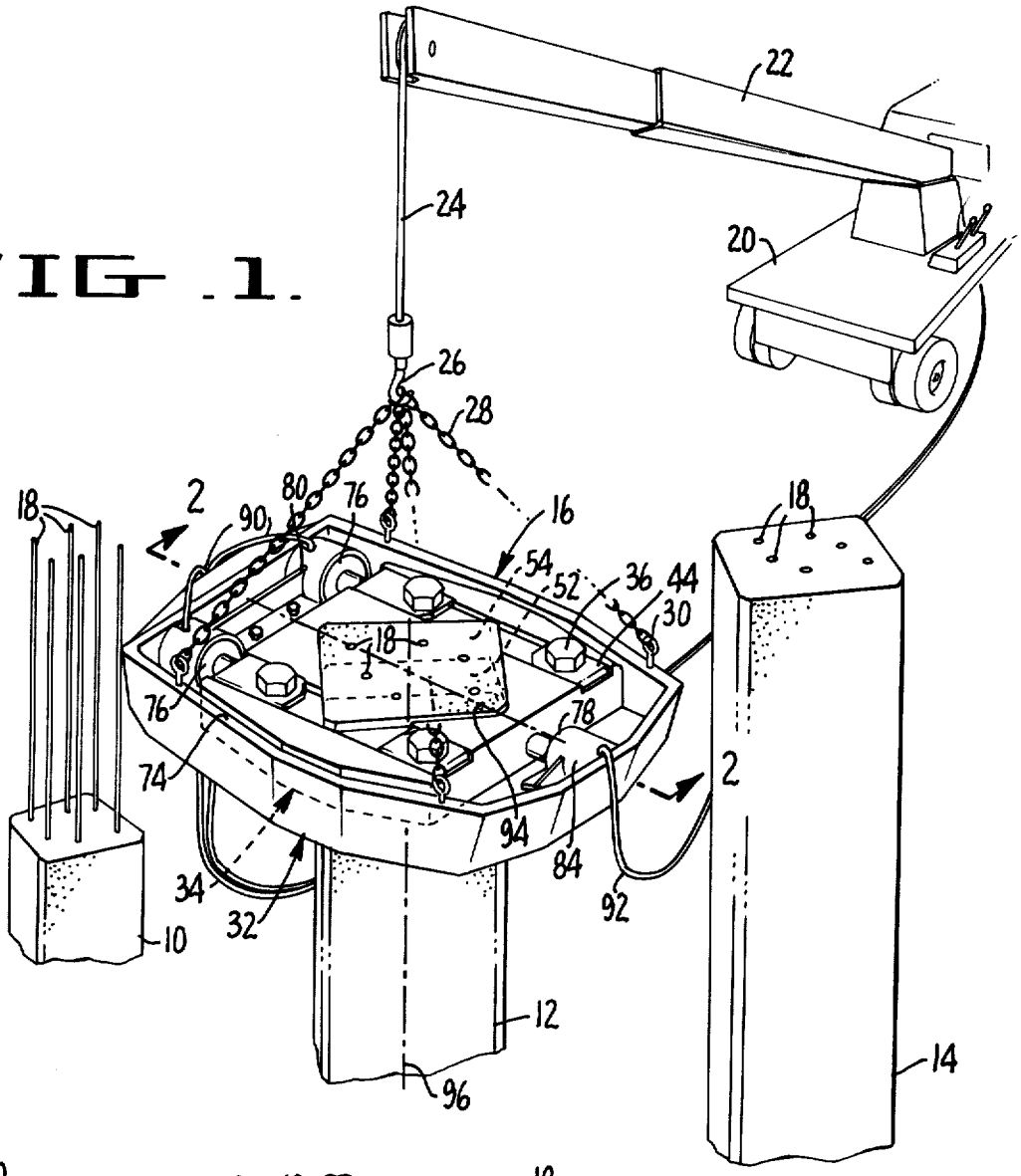
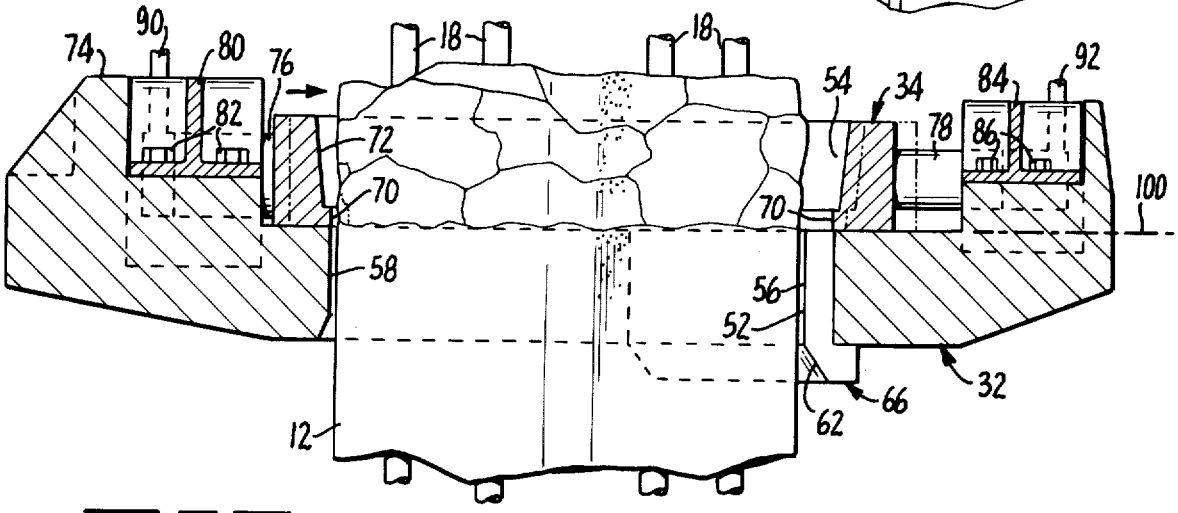
FIG. 2.

APPARATUS FOR CUTTING CONCRETE COLUMNS

REFERENCE TO RELATED APPLICATION

This application is a continuation-in-part application of my application Ser. No. 726,272, filed Sept. 24, 1976, and now abandoned.

BACKGROUND OF THE INVENTION

The present invention relates to an apparatus for cutting concrete columns and, particularly, is directed to such an apparatus for shortening prestressed concrete piles without severing the prestressing tendons therein.

Concrete piles of the type with which the present invention is intended to be used are typically precast with prestressing tendons formed therein and then driven into place at the construction site. Usually, the piles are of a length in excess of the ultimate length desired and, as a result, it is necessary to cut the piles to the desired length after they are driven into place.

One technique for cutting piles has been simply to saw the piles with an abrasive saw. This technique results in a relatively clean cut, but has the disadvantage that it severs the prestressing tendons in the pile, as well as the concrete. Severing the tendons is disadvantageous because it is generally desirable to leave the tendons extending from the free end of the pile in order that the tendons may be cast into the concrete slab or other structure ultimately to be supported on the piles. The sawing technique also has the disadvantage that it is relatively slow and that the saw blades require frequent replacement.

Another technique for cutting concrete piles has been simply to break the ends of the piles away with a jack hammer or similar device. This technique has the advantage that it preserves the tendons within the piles. It has the disadvantage, however, that it is very slow and expensive and results in a shortened pile wherein the distal end is of broken, irregular configuration.

The use of compression imparting techniques to divide or fracture stone or concrete is known in the prior art, as exemplified in U.S. Pat. Nos.: 247,569, 1,117,926; 3,062,294; and 3,705,747. U.S. Pat. Nos. 247,569 and 1,117,926 are concerned with devices to precisely split stones and U.S. Pat. No. 3,062,294 is concerned with an apparatus to fracture a subterranean formation. U.S. Pat. No. 3,705,747 is concerned with a demolition apparatus wherein crushing elements literally "chew" away the structure to be demolished. Although the structure disclosed in the latter patent bears some similarity to that of the present invention, it is no way suggests the apparatus of the invention which enables a column to be cut so as to leave a relatively planar end surface with the original column-reinforcing elements extending, intact, from the surface.

Additional prior art has been cited by the Patent Office during the prosecution of application Ser. No. 726,272 filed Sept. 24, 1976. The Valente U.S. Pat. No. 3,496,813 discloses an apparatus for shearing continuous billets which incorporates shears 96 and 98 which extend inwardly through the billet and actually cross each other during the shearing operation. In the present application, the shearing element is designed to perform two functions, i.e., first, the fracturing of the concrete column and, secondly, the crushing of a portion of the column above the shear plane. Valente makes no such suggestion.

Coffman U.S. Pat. No. 3,978,842 discloses a masonry block cutter which simply shears the masonry block, and is not designed to crush any portion of the block. Snell U.S. Pat. No. 82,886 shows a metal shear and does not suggest the crushing of the workpiece, let alone the breaking away of concrete from internal reinforcing tendons or reinforcing bars. Bowen U.S. Pat. No. 4,044,749 discloses a method and apparatus for breaking concrete from a concrete coated pipe to expose the pipe for repair work. Bowen uses three conical bits which are driven into the concrete and reciprocating through a 120° arc to break the concrete away in chunks. Bowen does not teach a shear plane as does the present invention on one side of which it is desired to crush the concrete and below which it is desired not to break the concrete. The Sugiki U.S. Pat. No. 3,727,599 teaches a method for cutting hollow concrete piles, but does not suggest the combined shearing and crushing action above a designated shear plane as does the present invention. The McRee U.S. Pat. No. 3,056,267 discloses a pile cutter for severing submerged piles at the mud line. A blade passes through the pile, simply shearing the pile. No suggestion is made of a combined shear and crushing action as with the instant invention. The Kemble U.S. Pat. No. 1,366,693 teaches a shearing mechanism and again does not suggest the combined crushing and shearing action of the present invention.

SUMMARY OF THE INVENTION

The apparatus of the present invention employs anvil and shear elements which are superimposed upon one another to define a shear plane therebetween. In operation, one side of the column to be cut is embraced by the anvil element and the other side is embraced by the shear element and the elements are forcibly moved relative to one another to impart fracturing and crushing force to the column. The anvil is conformed to embrace an area of the column of sufficient breadth to avoid crushing over said area and, as a result, concrete to the anvil element side of the shear plane is preserved intact.

When employing the apparatus to shorten a column wherein the length to be removed is greater than one-half of the mean diameter of the column, the fracturing steps are repeated successively over said length, starting proximate the distal end of the column and progressing to the level at which the final shear plane is desired. Preferably, the distance between the final shear plane and the shear plane immediately preceding it is chosen to be no greater than one-half the mean diameter of the column. So limiting this distance assures that substantially all axially extending fractures resulting from fracturing at the final shear plane will extend toward the distal end of the column and not materially disturb the integrity of the portion of the column to be preserved.

A principal object of the invention is to provide an apparatus for cutting a concrete column so as to provide an end surface thereon of preserved integrity and generally planar configuration.

Another and related object of the invention is to provide such an apparatus for shortening a concrete column without disturbing the integrity of any steel reinforcing elements within the column.

A more general object of the present invention is to provide such an apparatus which does not require the employment of jack hammers and/or concrete saws.

The foregoing and other objects of the invention will become more apparent when viewed in light of the accompanying drawings and following detailed description.

BRIEF DESCRIPTION OF THE DRAWINGS

FIG. 1 is a perspective view illustrating three adjacent concrete piles, with the center pile in the process of being shortened by the apparatus of the invention;

FIG. 2 is a cross-sectional view taken on the plane designated by line 2—2 of FIG. 1;

DESCRIPTION OF THE ILLUSTRATED EMBODIMENTS

Figure 3:
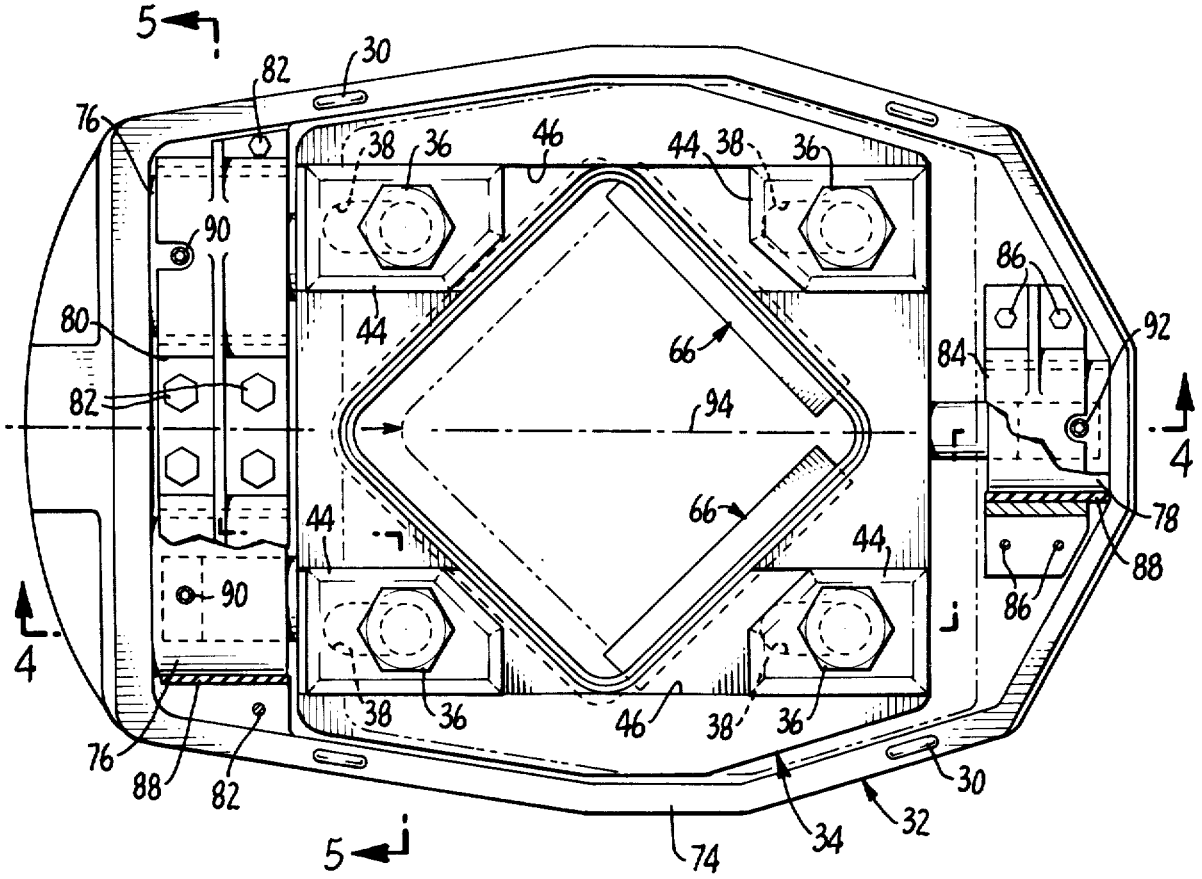
FIG. 3 is a plan view of the apparatus, with parts thereof broken away and shown in section.

FIG. 1 illustrates three adjacent columns 10, 12 and 14, respectively, with the center column 12 in the process of being shortened by the first embodiment apparatus, designated 16. As shown in FIG. 1, the column 10 has been shortened to the desired level, the column 12 is in the process of being shortened, and the column 14 has yet to be shortened. The columns 10, 12 and 14 are of the prestressed type wherein longitudinally extending steel tendons, designated 18, are bonded therein. The depiction of the column 10, in FIG. 1, illustrates that the ends of the tendons 18 which were originally embedded in the column are preserved intact, even though the end of the column has been removed.

FIG. 1 also illustrates a truck 20 having a crane 22 mounted thereon, from which crane depends a hoisting line 24. The line 24 is shown suspending the apparatus 16 through means of a hook 26 secured to the line and a plurality of chains 28 depending from the hook and secured to anchor eyes 30 secured at spaced locations about the periphery of the apparatus.

The basic components of the apparatus 16 comprise an anvil element 32 and a shear element 34 secured in superimposed relationship to one another to define a shear plane therebetween. Both of these elements are rigid and preferably fabricated of a high-strength material, such as cast steel. Bolts 36 extend slidably through slots 38 provided therefor in the element 34 and into secure engagement with threaded openings 40 provided therefor in the element 32. Lock nuts 42 are threadably received on the lower ends of the bolts 40 and guide washers 44 are received on the upper ends of the bolts 40 beneath the heads thereof. The washers 44 are slidably received within guide tracks 46 formed in the upper surface of the element 32 and are dimensioned to cover the slots 38. The upper surface of each of the guide tracks 46 is covered with a pad 48 of "bridge pad" type material and each of the washers 44 has a low-friction washer 50 received therebeneath for slidable engagement with the pad material. The washers 50 may be fabricated out of material such as "TEFLON".

Figure 6:
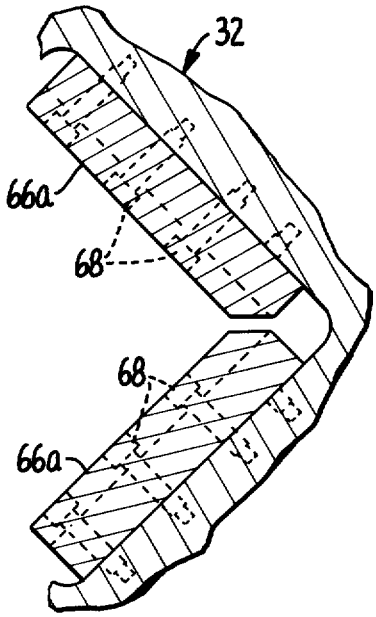
FIG. 6 is a cross-sectional view taken on the plane designated by line 6—6 of FIG. 4.

The elements 32 and 34 have aligned openings 52 and 54, respectively, extending therethrough for receipt about a column to be shortened. In the embodiment illustrated, these openings are of generally rectangular configuration. The opening 52 is bounded by vertically extensive surfaces 56 and 58 which terminate, respectively, in outwardly diverging surfaces 60 and 62. The surfaces 56 and 60 are formed on shoes 66 removably secured to the inside of the element 32 by bolts 68. The removable character of the shoes 66 enables their replacement in the event of wear and also enables the size of the opening in the element 32 to be adjusted to accommodate different sized columns. Such an adjustment may be seen from a comparison of FIGS. 4 and 6 wherein, in FIG. 4, the shoes 66 are relatively thin and, in FIG. 6, the shoes, designated **66*a*, are thicker. The opening 54 is bounded by a peripheral edge 70 extending at its lower extremity to the bottom edge of the element 34 to define, with the upper surface of the element 32, a shear plane. The upper end of the opening 54 is defined by a surface 72 which diverges outwardly relative to the edge 70**.

Figure 4:
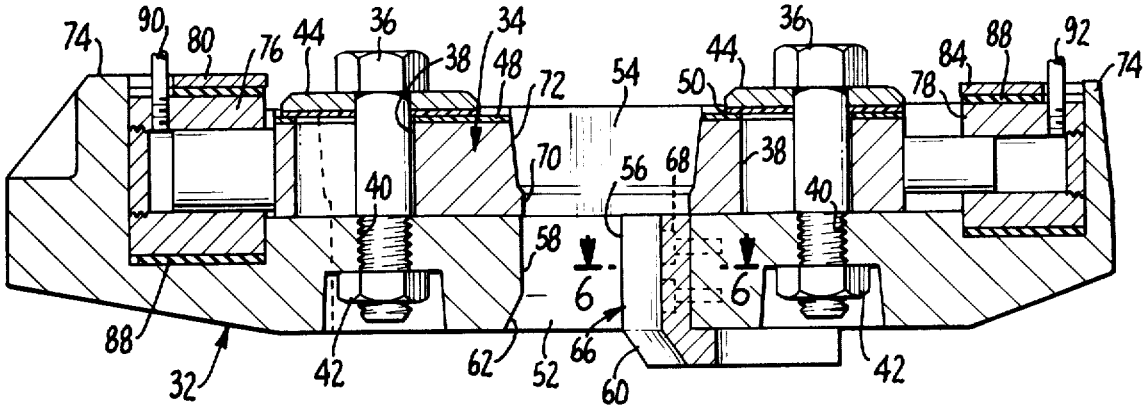
FIGS. 4 and 5 are cross-sectional views taken on the planes designated by lines 4—4 and 5—5, respectively, of FIG. 3.
Figure 5:
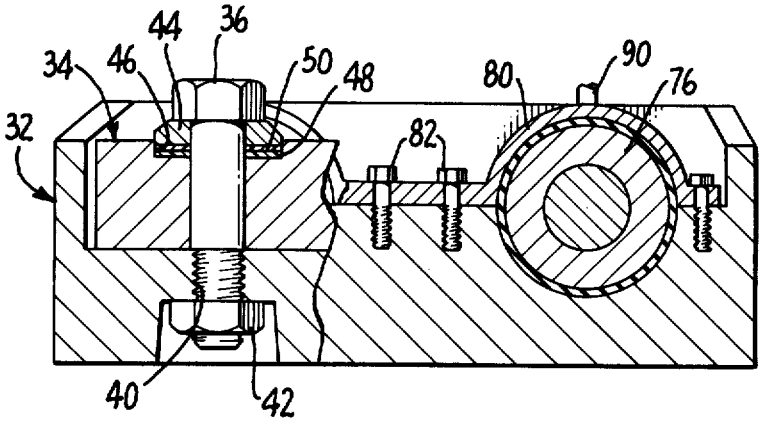

The element 32 is bounded by an upstanding peripheral wall 74 formed integrally therewith and the basic structure of the apparatus is completed by hydraulic compression cylinders or rams 76 interposed between the wall and one side of the element 34 and an hydraulic return cylinder or ram 78 interposed between the wall and the side of the element 34 opposite that engaged by the rams 76. The rams 76 are held in place by a saddle 80 secured to the element 32 by bolts 82 (see FIG. 5) and the ram 78 is held in place by a saddle 84 secured to the element 32 by bolts 86. Cushioning material 88 is received around the rams 76 and 78 to permit the cylinder portions of the rams to move slightly relative to the saddle mountings therefor to accommodate limited movement of the rams in response to expansion forces applied thereby. The material 84 should, ideally, be resilient so that it will not be permanently deformed in response to such forces. FIG. 4 best illustrates the positioning of the rams and the mounting means therefor. From this figure, it can also be seen that the cylinder portion of each ram is juxtaposed against the peripheral wall 74 and that the rod of each ram is juxtaposed in engagement with the element 34. Each ram has an hydraulic supply line communicating with the interior of the cylinder therefor, the lines for the rams 76 being designated 90 and the line for the ram 78 being designated 92.

FIGS. 1 and 3 illustrate the centerline, designated 94, of the path of movement of the element 34 relative to the element 32 and the position of the rams relative to the centerline. Namely, the rams 76 are symmetrically positioned to either side of the centerline in balanced relationship to one another and the ram 78 is positioned in alignment with the centerline. FIG. 1 also depicts the centerline 96 of the column 12 being shortened.

The sizes of the various components of the first embodiment apparatus 16 are dependent upon the size of the column to be cut. For a rectangular column measuring approximately 14 inches on a side, the following sizes are representative:

Rams 76: 100-ton capacity, 2¼" stroke
Rams 78: 50-ton capacity, 2⅜" stroke
Edge 70: ¾" in depth and ¾" in width
Surface 56: 4½" in depth These capacities and dimensions may vary. The important things are that the rams 76 have sufficient capacity to fracture and crush the column, that the edge 70 be of sufficiently limited depth that it can effectively fracture the column, but edge 70 must also be of great enough depth to crush the column, and that the surfaces 56 be of sufficient breadth to embrace the column without crushing. In the preferred arrangement, the edges 70 engage two sides of the column over substantially their entire widths and the surfaces 56 engage the remaining two sides of the column over substantially their entire widths. As measured angularly relative to the column axis 96, this means that the shear edges 70 engage the column over approximately 180° and the vertically extensive surfaces 56 engage the column over approximately 180°.

Field testing of the first embodiment apparatus 16 on 14" piling has produced new and helpful information regarding the design of the shear element 34 and anvil element 32. I have found that the relative dimensions of the shear element 34 and anvil element 32 are critical to the operation of the apparatus. In particular, I have varied the depth of edge 70 while keeping the depth of surface 56 constant. I have discovered that if edge 70 is of insufficient depth, the apparatus will not function properly and conversely if the depth of edge 70 is excessive, the apparatus will not function properly. In one field test, I reduced the depth of edge 70 to less than ¼ inch. As the shear element 34 was driven into the concrete piling, a thin fracture line was created through the concrete piling along the shear plane. It is desirable to fracture the concrete column across its cross section prior to crushing the concrete to form the cleanest possible cut. However, as surface 72 contacted the side of the concrete piling, rams 76 did not have sufficient force to drive surface 72 forward and crush the concrete column; and edge 70 did not have enough depth to crush the concrete column.

In another field test, I increased the depth of edge 70 to 2 inches. During this test, as rams 76 approached 50% of their loading capacity, which I feel to be the safe operating limit, there were no discernible fractures which extended through the column and the apparatus was incapable of crushing the concrete.

Further experimentation showed that as the depth of edge 70 ranged between ½ inch and 1¼ inches, the apparatus would function properly. The best performance was achieved with a depth of ¾ inch; the width of the edge was also ¾ inch. With these dimensions of edge 70, as the edge entered the side of the concrete piling, a relatively clean fracture became apparent along the shear plane across the entire width of the column. As edge 70 was driven further into the side of the column, and before surface 72 contacted the column, I was able to discern crushing of the concrete above and adjacent to the shear plane. My conclusion is that the relationships of the capacity of rams 76, the design of edge 70 and surface 56 are critical to performance of the apparatus. The edge 70 must be sufficiently limited in depth so that the rams 76 can generate enough force to shear whatever size piling is being cut. Conversely, edge 70 must be of sufficiently great depth and rams 76 of sufficient capacity to crush the concrete in the region above the shear plane after fracturing the column and cause the concrete to fail over its entire cross section in the region above the shear plane.

Lip **56*a* carried at the uppermost end of surface 56 has a depth of ¼ inch, and helps prevent spalling or peeling of the column beneath the shear plane in this region. The apparatus will perform adequately without lip 56*a***, but the lip has proven helpful in obtaining a clean fracture of the column with a minimum of spalling beneath the shear plane.

In use of the first embodiment apparatus 16, the apparatus is lowered over the end of a column to be crushed so that the column passes through the openings 52 and 54, as seen in FIGS. 1 and 2. In the preferred mode of operation, the apparatus is first lowered to a point where the shear plane between the elements 32 and 34, designated 100 (see FIG. 2) is spaced from the distal end of the column by a distance equal to approximately one-half of the mean diameter of the column. Mean diameter, as used with reference to an other-than-round column, may be treated as the diameter of the maximum size circle which could be drawn within a plane extending normal to the column. Once so positioned, the rams 76 are expanded to force the edge 70 of the shear element 34 into crushing engagement with the column, as depicted in FIG. 2. During this crushing engagement, the vertically extensive surfaces 56 of the shoes 66 engage the sides of the column opposite that engaged by the edge 70 and confine the column against substantial fracturing beneath the shear line 100. Once the area of the column above the shear line is crushed, the rams 76 are relaxed and the ram 78 is expanded to return the shear element 32 to the retracted position wherein the openings 52 and 54 are aligned.

In the preferred mode of operation, the above steps of lowering the apparatus 16 and activating the rams are successively repeated until the column is sheared to the desired ultimate length. Where the length of the column to be removed is very long, however, it is possible that the initial shearing steps may be effected at distances from the distal end of the column somewhat greater than one-half the mean diameter. This may result in some fracturing of the column beneath the shear plane, but such fracturing will not be objectionable, so long as it does not occur beneath the level to which it is ultimately desired to cut the column. Where such larger increments are employed, however, the last increment (i.e., the increment between the penultimate shear plane and the final shear plane) should preferably be no more than one-half the mean diameter of the column.

The purpose of limiting the distance between the penultimate and final shear planes is to assure that substantially all axial fracturing of the column occurs above the final shear plane. Fracturing can be so limited by limiting the length of the column above the final shear plane to an extent such that the resistance to axial fracturing provided by this length will be appreciably less than that provided by the length of the column beneath the final shear plane. As a rule of thumb, to assure this interrelationship, it has been found that the length of the column above the final shear plane should be no more than one-half the mean diameter of the column. Another reason for limiting the length of the column above the successive shear planes is to assure that a length of concrete to be removed is completely crushed and, thus, will fall away with ease. If the lengths of column between successive shear planes are excessive, it is possible that the concrete between the planes will not be completely fractured and crushed and that auxiliary means will have to be employed to break the partially fractured concrete away from the reinforcing tendons.

Figure 7:
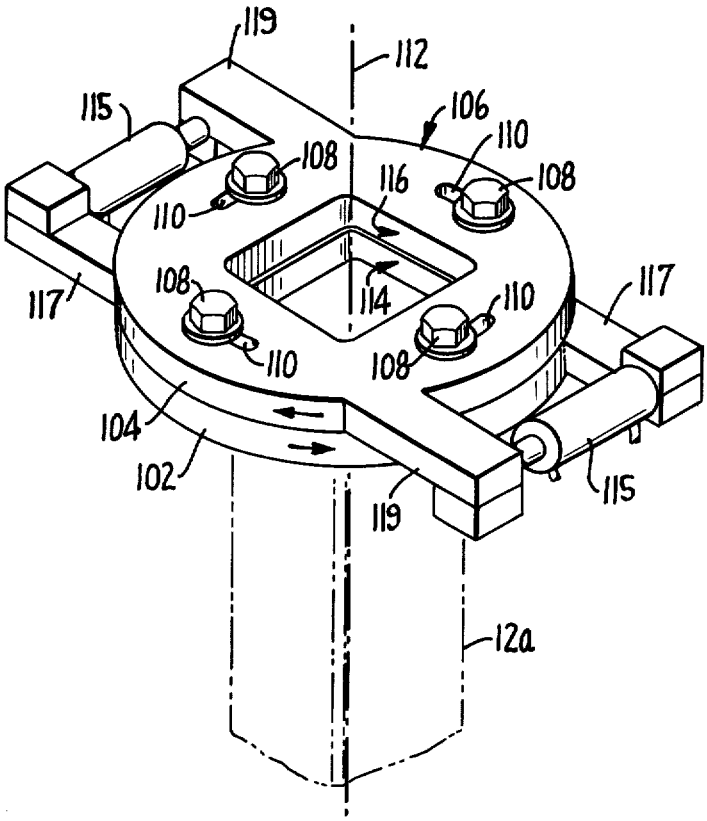
FIG. 7 is a perspective view of a second embodiment of the apparatus, with phantom lines illustrating the position which a column to be shortened would assume relative to the apparatus.

FIG. 7 illustrates a second embodiment apparatus wherein the anvil element is designated by the numeral 102 and the shear element is designated by the numeral 104. The second embodiment apparatus is designated in its entirety by the numeral 106 and differs from the first embodiment apparatus 16 primarily in that the shear and guide elements are mounted for curvilinear movement relative to one another, rather than rectilinear movement. It should be appreciated that the elements 32 and 34 of the first embodiment apparatus 16 are mounted for rectilinear movement along the centerline 94. Such guided movement is provided through means of slidable receipt of the guide washers 44 within the guide tracks 46.

Guided relative curvilinear movement between the elements 102 and 104 is provided by means of bolts 108 extending through arcuate slots 110 in the element 104 to secure threaded engagement with threaded holes (not illustrated) in the element 102. The slots 110 are concentric about the central axis, designated 112, of the elements 102 and 104. Aligned openings 114 and 116 are formed centrally of the elements 102 and 104, respectively, for receipt of the column to be cut by the apparatus 106. Such a column is depicted in phantom lines in FIG. 7 and designated by the numeral 12*a*.

Relative movement of the elements 102 and 104 about the axis 112 is provided through means of double-acting hydraulic cylinders 115 mounted between arms carried by the respective elements. The arms on the element 102 are designated by the numeral 117 and the arms on the element 104 are designated by the numeral 119. The arms and cylinders are so arranged that expansion of the cylinders 115 functions to move the shear element 104 in a clockwise direction relative to the anvil element 102. The arrow line in FIG. 10 indicates the direction of relative movement of the elements 102 and 104 responsive to expansion of the cylinders. Retraction of the cylinders functions to return the elements 102 and 104 to the aligned condition illustrated in FIG. 7.

In use, the apparatus 106 is lowered onto a column to be shortened and successively and progressively activated to fracture the column until it is shortened to the desired length. As with the apparatus 16, the shear plane provided by the apparatus 106 is defined by the innerface between the anvil element 102 and the shear element 104.

The principal difference in mode of operation between the apparatus 16 and the apparatus 106 is that the apparatus 16 fractures the column substantially totally through the employment of compressive forces to crush the column, while the apparatus 106 fractures the column by torsional force to shear the column. The use of torsional force to effect shearing has the advantage that the column can be fractured with considerably less force than is required to effect crushing by compression force. Concrete typically fails under compression at approximately 7,000 psi and under shear at approximately 150 psi. After fracturing the column, it is necessary to crush the concrete in the region adjacent the shear plane to break the concrete away from the reinforcing tendons and edge 70 is also required in this embodiment with the same design considerations as in embodiment 16.

From the foregoing detailed description and accompanying drawings, it is believed apparent that the present invention enables the attainment of the objects initially set forth herein. It should be understood, however, that the invention is not intended to be limited to the specifics of the illustrated and described embodiments, but rather is defined by the accompanying claims.

I claim:

1. Apparatus for cutting a concrete column having reinforcing tendons therein, said apparatus comprising: an anvil having a surface conformed to embrace one side of the column; a shear having an edge conformed to embrace the side of the column opposite that embraced by the anvil, said edge being disposed in a plane parallel and closely adjacent to the plane defined by the surface of the anvil; means mounting the anvil and shear for guided movement relative to one another into, and out of, embracing engagement with the column; compression means to forcibly move the anvil and shear relative to one another to fracture and crush the column; said edge being of sufficiently limited depth with respect to the capacity of said compression means and with respect to the size of said concrete column to cause fracturing through said column as said edge is driven into engagement with the column; and said edge having a sufficiently great depth with respect to the size of said concrete column and with respect to the capacity of said compression means to cause crushing of said concrete column in the region above said fracture after the column is fractured.

2. Apparatus, according to claim 1, wherein the surface of the anvil and edge of the shear are conformed, respectively, each to extend around more than 90° of the periphery of the column, as measured angularly relative to the axis of the column.

3. Apparatus, according to claim 1, wherein the mounting means guides the anvil and shear for rectilinear movement relative to one another.

4. Apparatus, according to claim 1, wherein the mounting means guides the anvil and shear for curvilinear movement relative to one another.

5. Apparatus, according to claim 1, wherein:

a. the anvil comprises a first rigid element having an opening extending therethrough for receipt around the column and a first surface defined by one side of the opening;

b. the shear is slidably supported on said element so that said edge may move over said opening to the side thereof opposite said one side; and, c. the compression means comprises at least one hydraulic cylinder coupled between said element and the shear.

6. Apparatus, according to claim 5, wherein the shear comprises a second rigid element having an opening extending therethrough for receipt around the column and said edge is defined by one side of said opening.

7. Apparatus, according to claim 5, wherein the mounting means secures said first and second elements together for guided rectilinear movement relative to one another and the hydraulic cylinder is coupled between said elements to impart such movement thereto.

8. Apparatus, according to claim 7, wherein the compression means comprises a pair of hydraulic cylinders coupled between said elements and disposed, respectively, in balanced force imparting relationship to either side of the centerline of relative rectilinear movement of said elements.

9. Apparatus, according to claim 5, wherein the mounting means secures said first and second elements together for guided curvilinear movement relative to one another and the hydraulic cylinder is coupled between said elements to impart such movement thereto.

10. Apparatus, according to claim 9, wherein the compression means comprises a pair of hydraulic cylinders coupled between said elements and disposed, respectively, at angularly spaced positions relative to the centerline of the openings extending therethrough.

11. Apparatus, according to claim 5, wherein the side of the opening in the first element which defines said first surface comprises a shoe removably secured to the inside of said opening.

12. Apparatus, according to claim 11, wherein said shoe carries a lip at its uppermost end.

13. Apparatus for cutting a concrete column having reinforcing tendons therein, said apparatus comprising anvil and shear elements disposed in superimposed relation to one another, to define a shear plane therebetween, said elements being conformed to embrace, respectively, opposite sides of a column; means securing said elements in superimposed relationship for slidable movement relative to one another into and out of embracing engagement with a column received therebetween; means to forcibly impart relative movement to the anvil and shear elements to move the elements toward one another and into engagement with a column received therebetween to fracture the column, said shear element having an edge of sufficiently limited depth with respect to the capacity of said means to forcibly impart relative movement and with respect to the size of said concrete column to cause fracturing through said column as said edge is driven into engagement with the column; and said edge having a sufficiently great depth with respect to the size of said concrete column and with respect to the capacity of said means to forcibly impart relative movement to cause crushing of said concrete column in the region above said fracture after the column is fractured.

14. Apparatus, according to claim 13, wherein said anvil element is conformed to embrace a column over an area of sufficient longitudinal and angular breadth that the column is confined against substantial fracturing and crushing over said area in response to movement of the anvil and shear elements toward one another to fracture the column.

15. Apparatus, according to claim 14, wherein the angular breadth of the anvil element conformed to embrace a column measures more than 90° relative to the longitudinal axis of the column.

* * * * *